US007374426B2

(12) United States Patent
Akamatsu

(10) Patent No.: US 7,374,426 B2
(45) Date of Patent: May 20, 2008

(54) CARD-EDGE BOARD CONNECTOR THAT ELECTRICALLY CONNECTS TWO BOARDS

(75) Inventor: Shinya Akamatsu, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/366,491

(22) Filed: Mar. 3, 2006

(65) Prior Publication Data

US 2006/0211275 A1 Sep. 21, 2006

(30) Foreign Application Priority Data

Mar. 16, 2005 (JP) ..... 2005-074197

(51) Int. Cl.
*H01R 12/00* (2006.01)

(52) U.S. Cl. ..... 439/62

(58) Field of Classification Search ..... 439/62, 439/65, 59, 67, 66, 31, 165, 325; 361/755
See application file for complete search history.

(56) References Cited

U.S. PATENT DOCUMENTS 3,701,071 A * 10/1972 Landman ..... 200/5 R
3,794,951 A * 2/1974 Hansen ..... 439/31
4,211,459 A * 7/1980 Madden ..... 439/325
5,161,981 A * 11/1992 Deak et al. ..... 439/66
5,308,248 A * 5/1994 Davidge et al. ..... 439/59
5,564,931 A * 10/1996 Fabian et al. ..... 439/62
5,967,814 A * 10/1999 Sikorski, Jr. ..... 439/165
5,995,373 A * 11/1999 Nagai ..... 361/755
6,093,038 A * 7/2000 Chen et al. ..... 439/131
6,848,927 B2 * 2/2005 Shirai ..... 439/326
6,997,720 B2 * 2/2006 Perret et al. ..... 439/67
7,097,479 B2 * 8/2006 Lee ..... 439/165

FOREIGN PATENT DOCUMENTS

| | | |
|---|---|---|
| JP | 60-142481 | 9/1985 |
| JP | 62-135382 | 8/1987 |
| JP | 63-152187 | 10/1988 |
| JP | 09-259992 | 10/1997 |
| JP | 2001-230005 | 8/2001 |

* cited by examiner

*Primary Examiner*—Chandrika Prasad
(74) *Attorney, Agent, or Firm*—Young & Thompson

(57) ABSTRACT

A card-edge board connector is provided which does not require a relay board, does not make connection of the card-edge board fixed at a certain position or does not cause a difference in propagation time of a signal even if connecting terminals of the card-edge board are disposed in two rows. The card-edge board connector includes a first connector on which a card-edge board is mounted, a second connector on which a board is mounted, a hinge for holding the first and the second connectors capable of rotational movement, and a flexible connecting board connected to between the first and the second connectors, for electrically connecting the card-edge board and the board to each other.

10 Claims, 3 Drawing Sheets

CARD-EDGE BOARD CONNECTOR THAT ELECTRICALLY CONNECTS TWO BOARDS

BACKGROUND OF THE INVENTION

1. Field of the Invention

The present invention relates to a card-edge board connector and particularly to a card-edge board connector for electrically connecting a card-edge board to another board.

2. Description of the Prior Art

In electronic equipment, a technology is known to mount an edge-connector type card such as a PCI (Peripheral Component Interconnect)-standard card or a memory card (hereinafter also referred to as card-edge board) onto a mother card (hereinafter referred only as board).

FIGS. 3 and 4 are perspective views showing an example of a conventional card edge connector. Referring to FIG. 3, the example of the conventional card edge connector is comprised by a relay board 13, a connector 14 and a board 12. The board 12 is a mother card as an example. The connector 14 is mounted on the board 12.

A sub-board 15 is connected to the relay board 13, and a recess portion 16 in which this sub-board 15 can be fitted is provided on the connector 14. Also, a recess portion 17 in which a board 11, which is a card-edge board, is fitted is provided on the relay board 13 on the surface opposing the mounting surface of the sub-board 15. This board 11 is inserted into the recess portion 17 of the relay board 13. And the sub-board 15 of the relay board 13 is inserted into the recess portion 16 of the connector 14. By this, a connecting terminal of the board 11, not shown, is electrically connected to the board 12 via the relay board 13 and the connector 14.

FIG. 4 is an example when the board 11 is mounted on the board 12. As shown in this FIG., in order to mount and connect the board 11 having the card-edge connecting terminal at the position parallel with the board 12, the angle of the board 11 is changed using the relay board 13.

On the other hand, an invention is disclosed as an example of this type of connector that a pair of detachable connectors is provided and one of the connectors is made capable of rotational movement with a hinge. Different print boards are connected to the both connectors (See Japanese Utility Model Laid-Open No. 60-142481, p. 7, 11. 9 to 17, FIG. 4)

Also, as another example, an invention is disclosed that a pair of plug and socket is provided and the plug is inserted into the socket and rotated by 90 degrees. The socket is provided on the board and the plug is provided at the tip end of a lead wire (see Japanese Utility Model Laid-Open No. 62-135382, p. 11, 1. 7 to p. 12, 1. 7, FIGS. 10 and 11)

Also, as another example, a connection structure is disclosed in which one printed board attached with a male connector and the other print board with a female connector are angularly changed within a range of 90 degrees from the state where they are connected on the same plane in the parallel direction and the state where they are connected perpendicularly (See Japanese Utility Model Laid-Open No. 63-152187, p. 2, 11. 5 to 11, FIG. 4)

Also, as another example, a connector for flat conductor is disclosed that a housing and an operating member are held capable of rotational movement and the flat conductor is made capable of insertion into the operating member. The rotation angle of the housing and the operating member is 90 degrees. (See Japanese Patent Laid-Open No. 2001-230005, paragraphs 0011 to 0012, FIGS. 1 and 2)

Also, as another example, a connector is disclosed that a main housing and a sub housing are axially bonded together capable of rotation. A multi-polar flat wire is inserted into the main housing (See Japanese Patent Laid-Open No. 09-259992, paragraph 0005, FIGS. 1, 2, 5 and 9)

Conventionally, when mounting a card-edge type card, a structure was adopted that the card-edge type card is held in parallel with a mother card in order to lower the mounting height. That is, as shown in FIGS. 3 and 4, the relay board 13 is used to change the angle of the board 11 by 90 degrees.

However, the conventional technique using the relay board 13 has the following problems. The first problem is that the necessity of the relay board 13 increases the number of components.

The second problem is that, since the position of the board 11 is fixed when it is connected to the relay board 13, a signal waveform of a portion covered by the board 11 in the circuit of the board 12 can not be observed.

The third problem is that, though the card-edge type card can have its connecting terminals disposed in two rows on the front and back of the card, a conductor in contact with the connecting terminal is folded by 90 degrees in the relay board 13 when the relay board 13 is used. Then, a difference is caused in the conductor length between the inside and the outside, which results in a difference in propagation time of a signal and leads to a malfunction.

On the other hand, the prior arts disclosed in the patent documents 1 to 5 are totally different from the present invention in the point that none of them relates to a card-edge board connector. Also, the constitution of the connector when the connecting terminals are provided in two rows as well as the constitution that the rotational angle of a pair of connectors is set to 90 degrees clockwise and counterclockwise are not disclosed in these patent documents 1 to 5.

An object of the present invention is to provide a card-edge board connector which does not need a relay board, does not make connection of a card-edge board fixed to a certain position or does not cause a difference in propagation time of a signal even if the connecting terminals of the card-edge board are disposed in two rows.

BRIEF SUMMARY OF THE INVENTION

In order to solve the above problems, a card-edge board connector according to the present invention is a card-edge board connector for electrically connecting a card-edge board to another board, comprising a first connector on which the card-edge board is mounted, a second connector on which the another board is mounted, a hinge portion for holding the first and the second connectors capable of rotational movement, and a flexible connecting board connected to between the first and the second connectors, for electrically connecting the card-edge board and another board.

Also, a multi-polar flat wire is disposed on the connecting board.

According to the present invention, the first and the second connectors are capable of rotational movement through the hinge portion, and electric connection between the first and the second connectors is rendered using the flexible connecting board, and the multi-polar flat wire is disposed on the flexible connecting board.

DETAILED DESCRIPTION OF THE PREFERRED EMBODIMENTS

Figure 1:
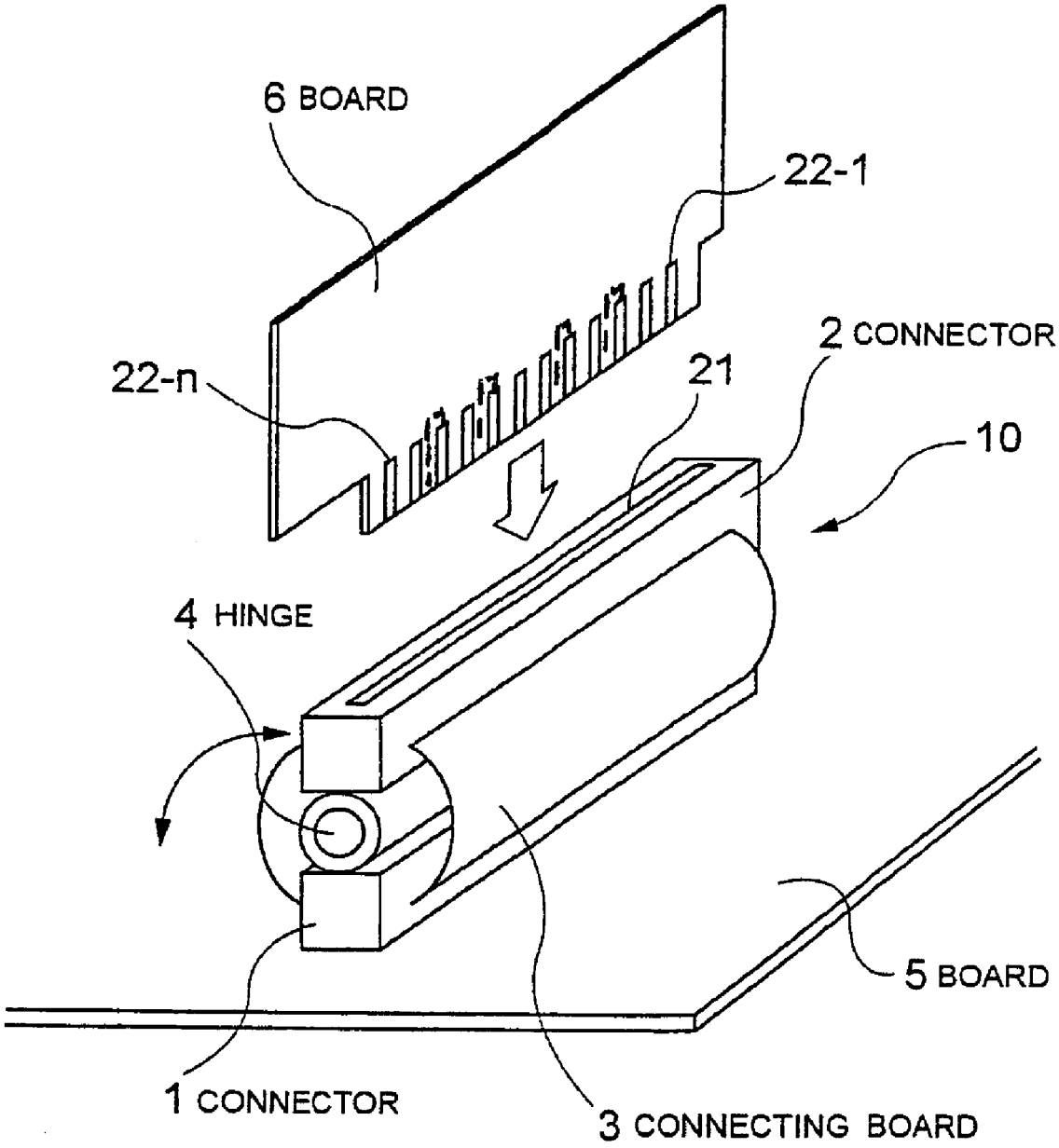
FIG. 1 is a perspective view of a preferred embodiment of a card-edge board connector according to the present invention.

Embodiments of the present invention will be described referring to the attached drawings. FIG. 1 is a perspective view of a preferred embodiment of a card-edge board connector according to the present invention. Referring to this FIG., a card-edge board connector 10 comprises a connector 1, a connector 2, a connecting board 3, a hinge 4 and a board 5.

The connector 1 is mounted on the board 5. The board 5 is a printed circuit board called as a mother card as an example. The connector 1 and the connector 2 are connected through the hinge 4 and they are made capable of mutual rotational movement.

The connector 1 and the connector 2 are electrically connected to each other with the connecting board 3. The connecting board 3 is constituted by a flexible material such as FPC (Flexible Printed Circuit), and a multi-polar flat wire is disposed on the connecting board 3. Therefore, an electric circuit on a board 6 is electrically connected to an electric circuit on the board 5 through the multi-polar flat wire in the connecting board 3. Even if the connector 1 and the connector 2 are moved rotationally through the hinge 4, a signal and power source can be flexibly transmitted.

Though FIG. 1 shows an example where the connecting board 3 is provided on both sides of the hinge 4, but the invention is not limited to this as the connecting board may be provided on one side. Also, the connector 2 is capable of rotational movement by a predetermined angle, 90 degrees, for example, in the clockwise and counterclockwise directions with respect to the connector 1.

A recess portion 21 is provided in the connector 2, and the board 6 is fitted in this recess portion 21. The board 6 is a card-edge board, and it is a PCI (Peripheral Component Interconnect)-standard edge connector card or a memory card, for example. This board 6 is plated with connecting terminals 22 (22-1 to 22-n: n is a positive integer), and the connecting terminals 22 are disposed in one row on one side of the board 6 or in two rows on the front and back thereof (the terminals on the back of board 6 are shown in dashed lines in FIG. 1). These connecting terminals 22 are electrically connected to a connecting terminal, not shown, provided on the recess portion 21 of the connector 2. As an example of the connecting terminal 22, a T/H pin or a lead for SMT (Surface Mount Technology) may be cited.

The multi-polar flat wires in the connecting board 3 are disposed in parallel on one plane. Therefore, even if the connecting terminals 22 on the board 6 are provided in two rows, the length of each wire of the multi-polar flat wires can be made equal, by which malfunction due to a difference in propagation time of a signal can be prevented.

Figure 2:
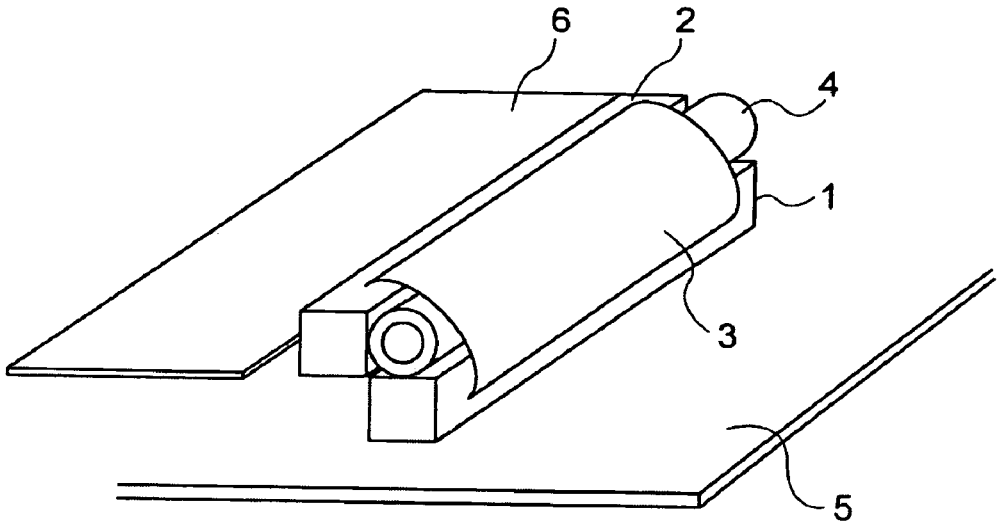
FIG. 2 is a perspective view of an example when a board 6 according to the present invention is mounted on a card-edge board connector 10.

FIG. 2 is a perspective view showing an example when the board 6 according to the present invention is mounted on the card-edge board connector 10. Since each of the components shown in this FIG. is the same as that in FIG. 1, only reference numerals are given and the explanation is omitted.

Referring to this FIG., the state where the board 6 is mounted onto the connector 2 and the board 6 is mounted in parallel with the board 5 is shown as an example. This FIG. shows the state where the board 6 is tilted toward the left with respect to the hinge 4, but it is possible to tilt it to the right. Also, the tilting angle is not limited to 90 degrees but may be an arbitrary angle within 90 degrees.

Figure 3:
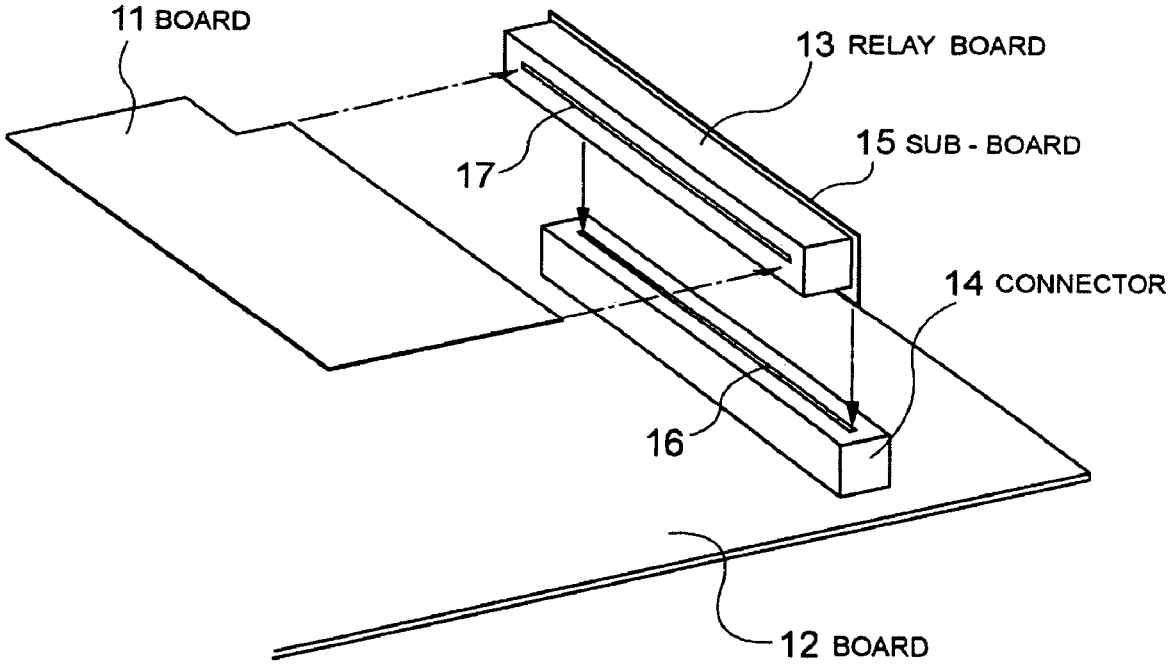
FIG. 3 PRIOR ART
FIG. 3 is a perspective view showing an example of a conventional card-edge connector.
Figure 4:
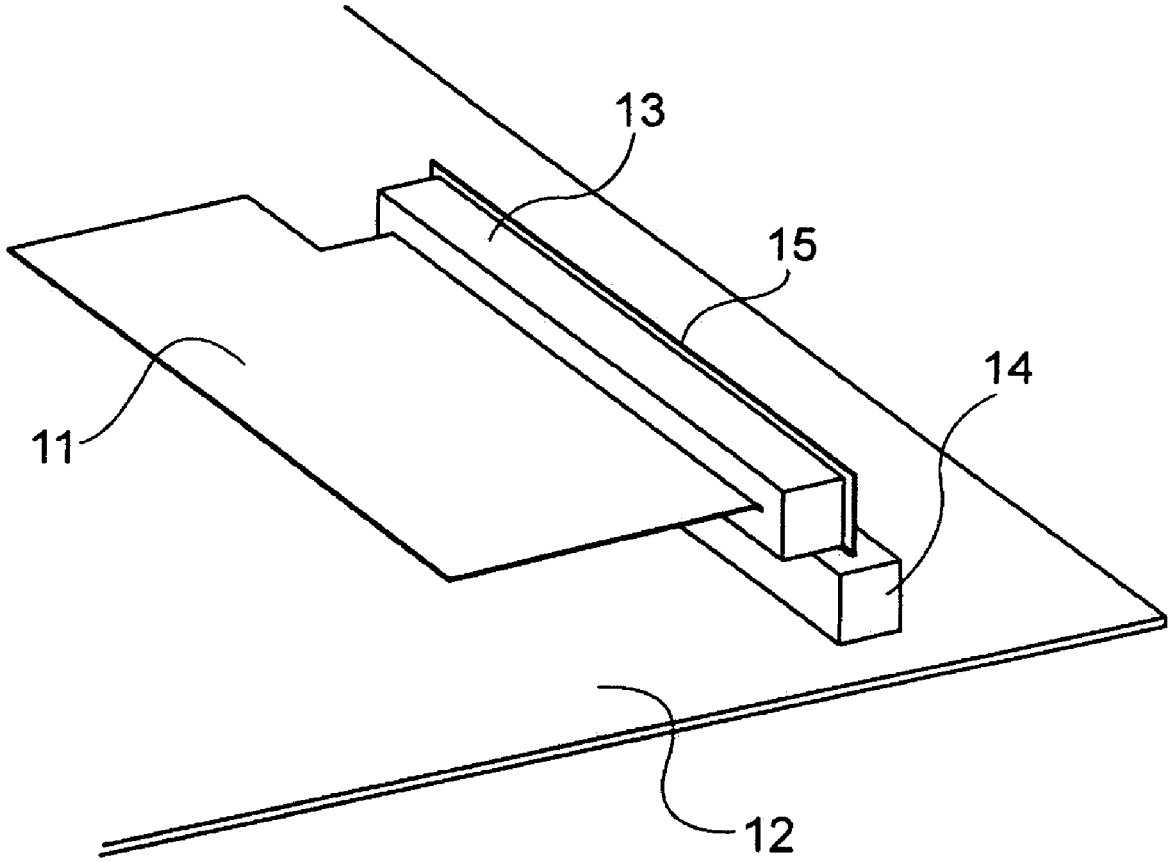
FIG. 4 PRIOR ART
FIG. 4 is a perspective view showing an example of a conventional card-edge connector.

That is, it is possible to direct the board 6 in the direction with advantageous workability and to accommodate and fix it at a position with good implementation performance after completion of mounting. Also, in the state where the board 6 is mounted in parallel with the board 5, it is difficult to perform waveform observation of an electric circuit of the portion on the board 5 covered by the board 6. But since the board 6 can be raised to a convenient angle in the present invention, the waveform observation can be made easily with the board 6 mounted. Also, the packaging density can be improved by lowering the mounting height. The relay board 13 (See FIG. 3) in the conventional example is not required any more.

According to the present invention, since the relay board is not required any more, the number of components can be reduced. Also, since the card-edge board is not fixed to a certain position, signal waveform observation becomes easy and maintenance workability is improved. Moreover, even if the connecting terminals of the card-edge board are provided in two rows, since the multi-polar flat wires in the flexible connecting board are disposed in parallel on one plane, the length of each wire can be made equal, by which malfunction due to a difference in propagation time of a signal can be prevented.

What is claimed is:

1. A card-edge board connector for electrically connecting a card-edge board to another board, comprising;

a first connector having a slot into which said card-edge board is inserted, a second connector on which said another board is mounted, a hinge portion for rotationally joining said first and second connectors, a first flexible connecting board connected to each of said first and second connectors, and a second flexible connecting board connected to each of said first and second connectors, wherein each of said first and second flexible connecting boards electrically connects said card-edge board to said another board and is external to and spaced from said hinge portion, said second flexible connecting board being on a side of said first and second connectors opposite said first flexible connecting board, and wherein said slot is in a side of said first connector that is between opposite sides of said first connector to which said first and second flexible connecting boards are connected.

2. The card-edge board connector according to claim 1, wherein a multi-polar flat wire is disposed on each of said first and second flexible connecting boards.

3. The card-edge board connector according to claim 1, wherein one of said first and second connectors is capable of rotational movement only by a predetermined degree in the clockwise and counterclockwise directions with respect to the other.

4. The card-edge board connector according to claim 1, wherein said card-edge board is plated with connecting terminals, and said connecting terminals are disposed in two rows on the front and back of said board.

5. The card-edge board connector according to claim 1, wherein said card-edge board is a PCI (Peripheral Component Interconnect)-standard edge-connector type card or a memory card.

6. The card-edge board connector according to claim 1, wherein said connecting board is comprised of FPC (Flexible Printed Circuit).

7. The card-edge board connector according to claim 1, wherein the side of said first connector having said slot is opposite said hinge portion.

8. The card-edge board connector according to claim 1, wherein said first connector extends longitudinally longer than said slot and wherein said hinge portion extends longitudinally a same length as at least one of said first and second connectors.

9. The card-edge board connector according to claim 1, wherein said first connector extends longitudinally longer than said slot and wherein a connection of said first flexible connecting board to said first connector extends longitudinally parallel to said hinge portion.

10. The card-edge board connector according to claim 9, wherein said hinge portion extends longitudinally a same length as at least one of said first and second connectors.

* * * * *